United States Patent [19]

Tecl et al.

[11] 4,451,520

[45] May 29, 1984

[54] SPOT BONDED PATTERN FOR NON-WOVEN FABRICS

[75] Inventors: Bohuslav Tecl; Erich Fahrbach; Jürgen Knoke; Hans C. Assent, all of Weinheim, Fed. Rep. of Germany

[73] Assignee: Firma Carl Freudenberg, Weinheim an der Bergstrasse, Fed. Rep. of Germany

[21] Appl. No.: 452,069

[22] Filed: Dec. 22, 1982

[30] Foreign Application Priority Data

Apr. 30, 1982 [DE] Fed. Rep. of Germany ..... 3216099

[51] Int. Cl.[3] ..... B32B 27/14

[52] U.S. Cl. ..... 428/198; 428/195; 428/296

[58] Field of Search ..... 428/195, 198, 296

[56] References Cited

U.S. PATENT DOCUMENTS 4,275,105 6/1981 Boyd et al. ..... 428/198

FOREIGN PATENT DOCUMENTS 1307386 9/1962 France ..... 428/198

*Primary Examiner*—James J. Bell

*Attorney, Agent, or Firm*—Kenyon & Kenyon

[57] ABSTRACT

This application relates to a non-woven fabric wherein the fibers of the fabric are bonded to each other and/or to another material in a plurality of equally spaced-apart spots, wherein the spots are the same size and are combined in a plurality of identical groups of not less than three nor more than five identical spots, each of said groups of spots being spaced apart from each other, and each of said spots within each group being positioned along a curved or straight line wherein the steady extension of said line beyond the end-spots of said group positioned along said line intersects and adjacent line along which an adjacent group of spots is positioned, and wherein the ratio of the distance separating the spots within each group of spots to the distance from an end-spot in each group to the next adjacent line along which an adjacent group of spots is positioned, is about 0.5 to about 3.0.

13 Claims, 5 Drawing Figures

FIG. 1
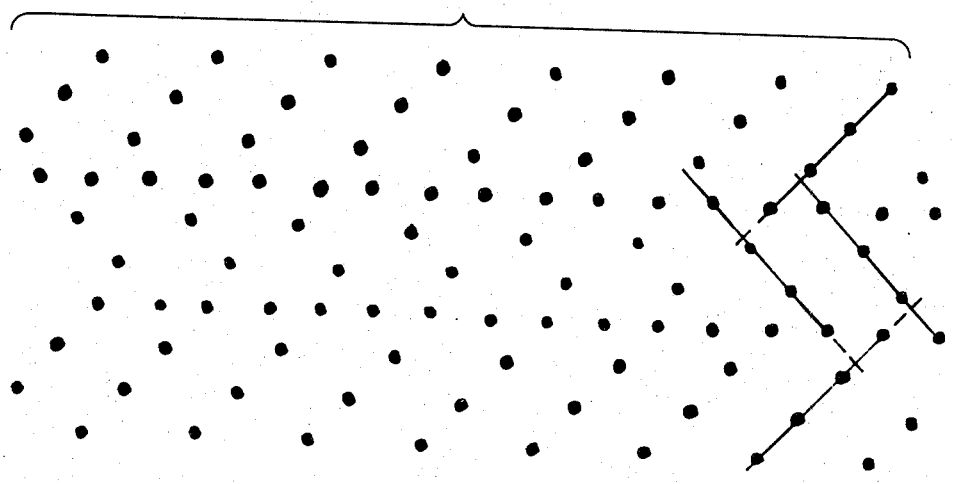
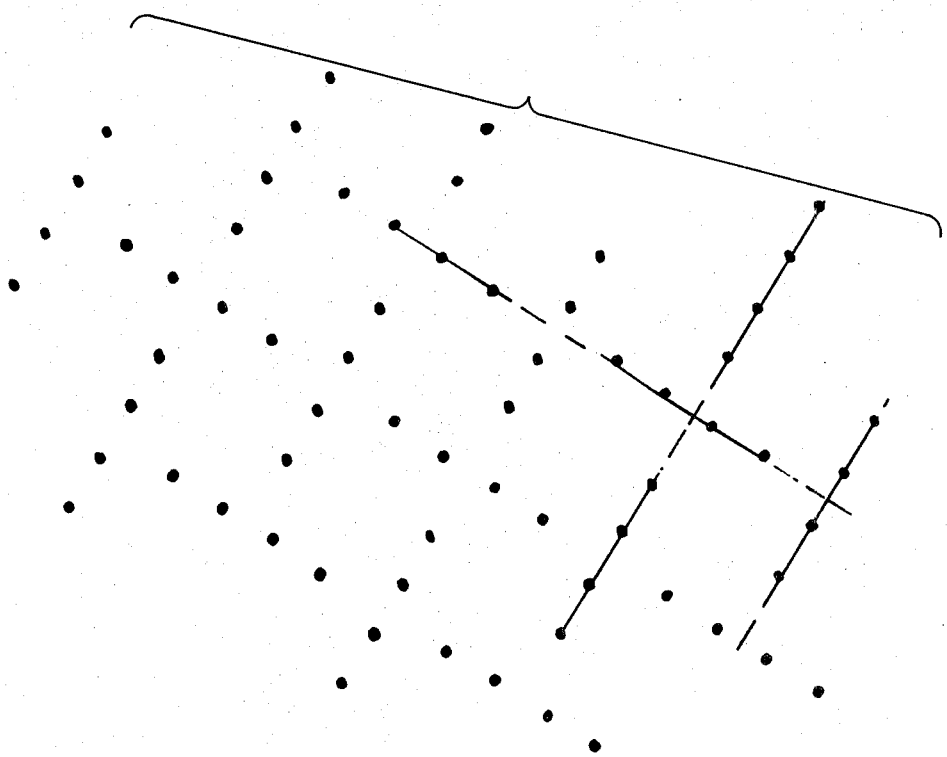
FIG. 2

SPOT BONDED PATTERN FOR NON-WOVEN FABRICS

German Offenlegungsschrift No. 1954801 discloses a non-woven fabric with bonding spots which are mutually spaced apart, and wherein the fibers of the fabric are bonded together and/or to another material autogenously and/or by a bonding agent. The spots are arranged in parallel, uniformly subdivided group lines, and contain a thermally softenable adhesive compound, whereby the non-woven fabric, in the form of an insert fabric, may be bonded to an outer fabric in the course of an ironing operation.

Due to the regular spacings of the thermal-adhesive spots in the longitudinal and the transverse direction on the non-woven fabric, complete coincidence with the warp and woof threads of an outer fabric material is obtained at regular spacings and, thereby, changes in the light reflection properties can occur. Such changes in light reflection are referred to as the moirée effect, and are very undesirable.

Furthermore, the thermoplastic adhesive compound is softened during the ironing process and penetrates into the interior of the pore structure of the woven fabric, as well as into the pores of the non-woven fabric resulting in a certain amount of hardening, as well as a reduction in bending elasticity. The reduction in bending elasticity is not neutral as to direction in a stiffening material prepared according to DE-OS 1954801. Rather it is disposed in a direction parallel or transverse to the extension of the group lines, which is not compatible with fashion considerations.

German Auslegeschrift No. 1096324 refers to an embodiment wherein an adhesive compound is sprinkled as a powder onto the surface of a non-woven fabric, and is subsequently cured. In this case, the spacings of the particles forming the spots vary in accordance with a Gaussian distribution, i.e., spot spacings are present in which two adjacent particles directly touch each other, while other spot spacings greatly exceed the average spacings between the spots. In the first-mentioned case, where two spots of the thermoadhesive touch, penetration of the thermoplastic adhesive which is softened by ironing can penetrate through both the non-woven fabric, as well as through the outer fabric material to which the non-woven fabric is bonded. This is undesirable. In the last-mentioned case, where the spots are disproportionately spaced apart, partially insufficient strength of the bond between the non-woven fabric, and the outer material is obtained, which is troublesome, for instance, in the vicinity of folded edges.

Melliand Textiberichte, 4/1973, makes reference on page 377 to a computer spot system with respect to the mutual correlation of adhesive-compound spots. In this system, geometric regularity is replaced by a statistically calculated irregularity. The statistical irregularity relates to the position, as well as to the mutual distance of spots from each other. In addition, the diameters of the individual spots must be varied. The detailed application requirements of this system entail considerable costs. In addition, considerable difficulties can arise in the ironing process inasmuch as the different adhesive compound volumes per adhesive spot require the supply of different amounts of heat for activating the spot to maximum adhesion power. With mutual spot spacings of about 2.5 mm, and the conventionally available ironing presses, this is not possible. A large part of the adhesive compound applied by the computer spot system, therefore, in actuality contributes nothing to the bonding of the stiffening material to the outer material. However, it clogs a large number of the pores of the stiffening material, which is undesirable in view of the desirability of good breathability.

It is an object of the present invention to provide a non-woven fabric, which is free from the disadvantages outlined above, which exhibits direction-neutral bending behavior and has spots of equal size and shape.

BRIEF DESCRIPTION OF THE INVENTION

In accordance with the foregoing, the present invention provides a non-woven fabric having spots which are mutually spaced, wherein the fibers are cemented to each other and/or to another material autogenously and/or by a bonding agent, in a spot pattern, wherein the spots are of the same size and are combined in identical and uniformly subdivided groups to form lines, wherein the group lines are comprised of at least three and at the most five spots and are related to each other in such a way that the steady extension of each group line beyond the end-spots intersects the adjacent group lines and wherein the ratio of the division T within each group to the distance of the end-spots to the next adjacent group line is about 0.5 to about 3.0, and preferably about 0.8 to about 1.6.

DETAILED DESCRIPTION OF THE INVENTION

Figure 3:
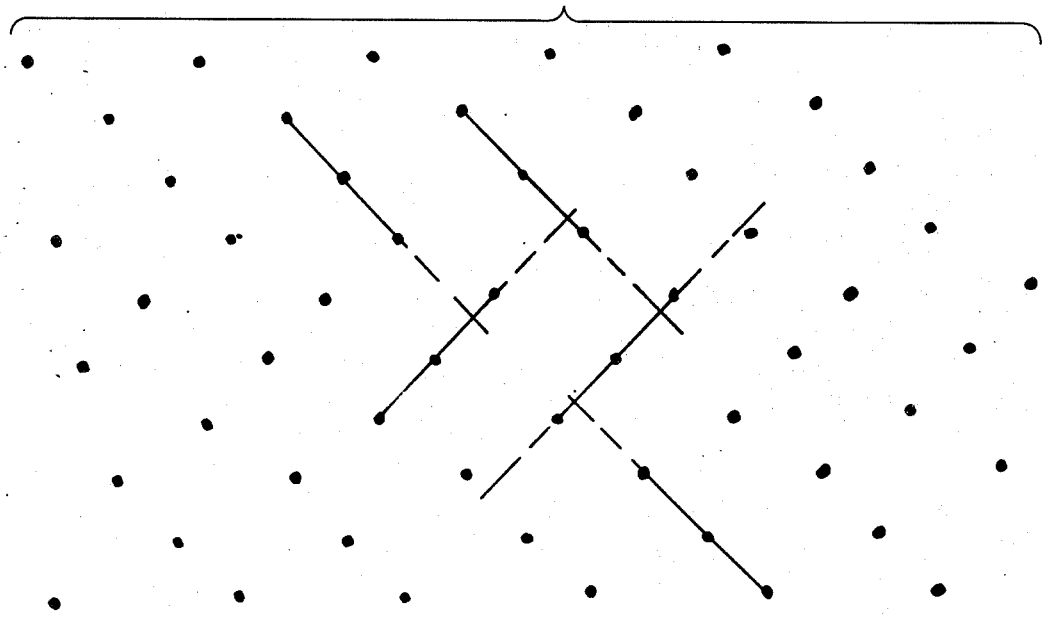

In accordance with this invention the fibers of a non-woven fabric produced in a conventional manner are bonded together and/or to another material in a particular spot-wise pattern, described in further detail below. The fibers may be bonded together in the location of the spot by one of the adhesives (i.e. thermoplastics, etc.) employed to adhere fibers of non-woven fabrics, or the fibers of the non-woven fabric themselves may be comprised of adhesive fibers, e.g., thermoadhesive fibers which adhere together upon the application of heat and pressure. Fibers which adhere to each other are said to be bonded together autogenously.

This invention relates to a spot pattern through which the fibers of the non-woven fabric are bonded together and/or to another fabric to provide a non-woven fabric product which exhibits a direction-neutral bending behavior. The spots are of equal size and shape.

The non-woven fabrics employed herein may be formed, for example, from 100% polyester fibers with a titer of 1.7 dtex, and a cut length of 38 mm, or from non-woven fabrics which include bicomponent fibers such as a non-woven fabric formed on a carding machine from 15% bicomponent fibers with a titer of 3.3 dtex. The fibers of non-woven fabrics of the above-described type bond together when they are subjected to heat and pressure.

The spot pattern of this invention can be employed to bond the fibers of a non-woven fabric to each other and, thereby, to solidify the non-woven fabric. In addition, the spot pattern can be employed to adhere a non-woven fabric in the form of an insert or stiffening material to an outer fabric layer. For example, the spot pattern which may be comprised of a thermoadhesive may bond the fibers of the non-woven fabric together as well as the fibers of the non-woven fabric to the woven fabric layer.

In the non-woven fabric of the present invention the spots preferably have a circular shape. The diameter and the relative spacing of the spots are adjusted to attain optimal mutual bonding of the fibers of the non-woven fabric to each other, and/or to another material. The diameter remains the same; in a light-weight insert material, for instance, of the weight class of 60 to 80 g/m$^2$, it is 1.6 to 1.8 mm, while the corresponding center spacing is partially the same and partially statistically varied about an average value of about 2.3 mm.

The spots which are of equal size are combined in groups along identically configured and uniformly subdivided lines, referred to herein as group lines. The group lines are related to each other in a constant manner. The distribution of spots is not a statistical distribution, but an absolutely regular distribution which not only can be attained in a technically simple way, but in addition provides the advantage of ideal scatter distributions, and the assurance of direction-neutral bending behavior of the non-woven fabric treated in this manner.

The non-woven fabric of this invention can be adhered optimally to another material with a most economical use of adhesive compound or bonding agent, or the fibers of the non-woven fabric can be bonded together autogenously using the spot pattern of this invention. For example, adhesive may be applied to a non-woven fabric by conventional means, in the spot pattern of this invention. The treated non-woven fabric may then be bonded to an outer fabric layer (e.g., a woven fabric) by a conventional ironing process. The adhesive may bond together the fibers of the non-woven fabric and/or the non-woven fabric to another fabric. Alternatively the bonding in the spot pattern of the present invention may be accomplished autogenously. In accordance with this invention the unavoidable hardening or clogging of the fabric pores in the micro-region is minimized, while good breathability in the fabric is retained.

Additionally, in the non-woven fabric of this invention, there is a tendency that fold lines are formed in line with the group lines. However, they do not manifest themselves in a disturbing manner, inasmuch as the intersections of the steady extensions of the group lines with adjacent group lines, leads to an equalization which is equivalent to a direction-neutral bending behavior. The individual group lines should, therefore, not be too extensive and it is preferred not to include more than five dots in each group line. Additionally, the small size of the group lines aids greatly in avoiding moirée effects.

The ratio of the separation between adjacent spots within each line of spots to the distance between the end-spot in a line of spots to the next adjacent line of spots should be about 0.5 to about 3.0, and preferably about 0.8 to about 1.6. Moreover, the length of each line of spots is preferably about 1.5 to about 5 times the smallest distance between the spot lines. This ratio relates to obtaining direction-neutral flexibility, as well as to the avoidance of moirée effects.

The separation T between spots is measured between the closest points between adjacent spots. The distance (A) from a spot to a line is measured from the closest point between an end-spot in a line to the adjacent line formed by interconnecting the mid-points of spots in an adjacent group of spots. (See, e.g., the solid lines in the appended Figures.)

The irregular-appearing distribution of the spots on the surface and the direction-neutral properties can be enhanced by intrinsically curved lines of spots, and the corresponding extensions. Continuously extended lines of spots may intersect adjacent lines of spots at an angle of 25° to 90°, and preferably at an angle of 45° to 60°. Especially within the last-mentioned range of 45° to 60°, a particularly uniformly scattered-appearing pattern results.

According to an advantageous further embodiment of the invention, it is provided that the steady extensions of the lines of spots intersect adjacent lines of spots outside the lines' mid-point. The group lines are thus not arranged in line with continuous curves, and the bending effectiveness of each individual line of spots is thereby not aided by that of other groups.

The present invention will be illustrated further with reference to the appended drawings. For reasons of clarity, the non-woven fabric itself has been omitted here and the presentations are confined to an enlarged rendering of the mutual correlation of the spots proper. Several lines of spots are illustrated by respective solid lines, and the corresponding extensions of the lines of spots by dashed lines.

FIG. 1 shows an embodiment in which four spots form a line. Adjacent lines of spots are related to each other by a right angle, and the steady extensions of each line of spots intersect an adjacent line of spots outside the center point of the adjacent line of spots. The ratio of the separation T of the spots within each group to the distance (A) of the end spots to the next adjacent line of spots is 1.6 in FIG. 1.

FIG. 2 refers to an embodiment similar to FIG. 1, with the exception that the steady extensions of each line of spots beyond the end spot intersects an adjacent line of spots symmetrically. The ratio of the separation T of the spots within each line to the distance (A) of an end-spot in one line to the next adjacent line of spots is 0.77.

FIG. 3 refers to an embodiment in which the steady extension of each line of spots beyond the end-spot intersects the adjacent line of spots asymmetrically at an angle of 53°. Each individual line is comprised of three spots which are arranged on a straight line. The ratio of the separation T of the spots within each line to the distance (A) of the end spot from the next adjacent line of spots is 0.9.

Figure 4:
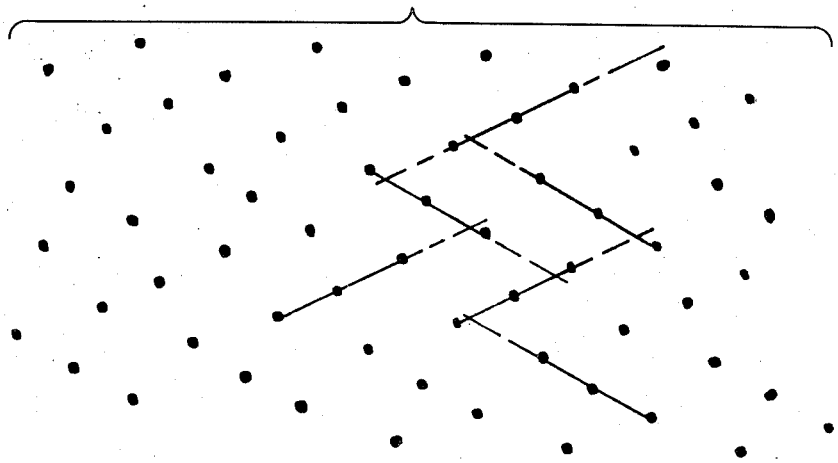

FIG. 4 discloses an embodiment corresponding to FIG. 3 with the exception that the steady extension of each group line beyond the end-spots intersects the adjacent line of spots, as in FIGS. 1 and 2, at an angle of 90°. Also in this case, three spots always form a group related together in a straight line, which is not immediately discernible with the naked eye.

Figure 5:
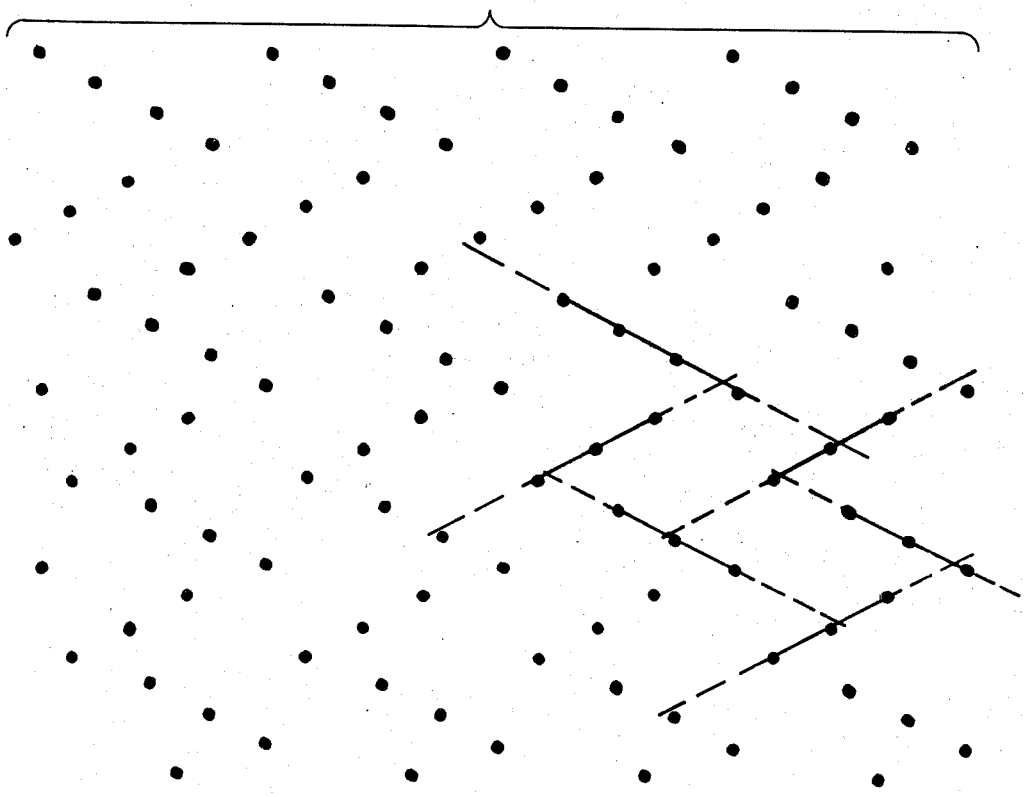

FIG. 5 relates to a distribution in which four spots are combined in a group in the upper part of the figure, but only three spots in the lower part of the figure. All spots are arranged within groups along straight group lines which are intersected by the steady extension of adjacent lines of spots at an angle of 54° outside the center point of the adjacent line. The relatively dense distribution in the lower part of the figure changes without a seam into the somewhat more open distribution in the upper part of the figure. Accordingly, an adhesive compound placed in the non-woven fabric can thereby have a particularly great adhesion power desired regionally, without unnecessarily impairing the desired breathability of the fabric product. The ratio of the separation T of the spots within each group to the distance (A) of the end spots from the next adjacent group is 0.72 in the upper portion, and 1.0 in the lower portion.

The invention will be described further with reference to the following examples:

EXAMPLE 1

A non-woven fabric with an area weight of 40 g/m$^2$ is made on a carding maching from 100% polyester fibers having a titer of 1.7 dtex, and a cut length of 38 mm. This fabric is solidified spot-wise between a smooth steel cylinder and an engraved steel cylinder. The latter has raised areas distributed over its surface (hereinafter raises) in the form of truncated pyramids with a base area of 0.7×0.55 mm and a height of 0.75 mm. Twenty raises are provided per cm$^2$. The mutual spacing in the transverse direction is 2.0 mm and in the longitudinal direction, 2.0 mm. The cylinders have a surface temperature of 230° C., and they bear against each other in the roll gap with a line pressure of 50 kg/cm. The raises which are impressed into the fabric during its passage through the roll gap cause the fibers of the fabric to be fused together in the respectively compressed zones. The latter occupy, share-wise, an area of 7.7% of the total area of the fabric.

EXAMPLE 2

A non-woven fabric with an area weight of 50 g/m$^2$ constructed in accordance with Example 1 is solidified spot by spot in the same manner, using the apparatus described.

EXAMPLE 3

A non-woven fabric with an area weight of 40 g/m$^2$ is formed on a carding machine from 15% bicomponent fibers having a titer of 3.3 dtex, and a staple length of 50 mm; 55% polyamide fibers with a titer of 3.3 dtex and a staple length of 51 mm, and 30% polyester fibers with a titer of 1.6 dtex and a staple length of 40 mm.

This fabric is solidified in zones physically separated from each other by passing it between two steel cylinders which are pressed against each other. One cylinder has an engraved surface. The engraving again consists of raises which extend from the surface of the one steel cylinder in the form of truncated pyramids and have a base area of 0.8×0.55 with a height of 0.68 mm. 30 such raises are provided per cm$^2$, the spot spacing being 2.1 mm in the transverse direction and 1.6 mm in the longitudinal direction. The surface temperature of the cylinders is 225° C. with a line pressure between the rolls of 50 kg/cm. As the non-woven fabric passes through the roll gap, the fibers in the vicinity of the superficial raises are welded together. The corresponding zones occupy 13.2% of the total area.

EXAMPLE 4

A fibrous fabric of the composition as per Example 3, but with an area weight of 50 g/m$^2$ is solidified in the apparatus from Example 3 under the conditions mentioned there.

EXAMPLES 5 TO 8

The fibrous fabrics according to Examples 1 to 4 are solidified under the same conditions as described above between a smooth and an engraved steel roller. The superficial raises of the engraved roller correspond to the data above, but they are related to each other not as described, but rather in the spot pattern illustrated by FIG. 4. The area-wise share of the surface zone fused together, obtained in this manner, was 6.7% in Examples 5 and 6, and in Examples 7 and 8, 13.4%.

Samples were cut from the non-woven fabric materials prepared according to the examples above and subjected to the following test in order to determine the draping coefficients of the samples which were prepared.

The draping coefficient is determined in accordance with DIN 54 306. A circular disc with a diameter of 36 cm is cut from the fabric material to be measured and clamped coaxially between two circular horizontally arranged plates with a diameter of 18 cm. The plates are lifted until the edge of the sample hangs down freely on all sides. Subsequently, light is thrown thereon coaxially from below, whereby the edge is clearly imaged on a horizontal circular disc of transparent paper arranged above the sample. The edge is traced on the circular disc and the latter is cut out along the line so obtained. Subsequently, the weight of the entire disc M1 is brought into relationship with that of the subarea M2 inside the line, according to the following formula:

$$\text{Draping coefficient } D=(M2/M1)\times 100.$$

The individual values for the samples prepared according to Examples 1 to 8 are compiled in the following Table:

| Ex. No. | Row Spot Draping Coeff. (%) | Ex. No. | Spot Arrangement per FIG. 4, Draping Coeff. (%) | Improvement of Draping (%) |
|---|---|---|---|---|
| 1 | 55.45 | 5 | 37.98 | 31.5 |
| 2 | 58.28 | 6 | 44.10 | 24.3 |
| 3 | 66.30 | 7 | 48.94 | 26.1 |
| 4 | 92.32 | 8 | 64.11 | 30.5 |

While specific embodiments of the invention have been described with particularity herein, it should be understood that this invention is intended to cover all changes and modifications of the embodiments of the invention chosen herein for purposes of illustration which do not consitutute departures from the spirit and scope of the present invention.

What is claimed is:

1. A fabric comprising a non-woven fabric wherein the fibers of said fabric are bonded together by a bonding agent and/or autogenously in a plurality of equally spaced-apart spots, wherein the spots are the same size and are combined in a plurality of identical groups of not less than three nor more than five identical spots, each of said groups of spots being spaced apart from each other, and each of said spots within each group being positioned along a curve or straight line wherein the steady extension of said line beyond the end-spots of said group positioned along said line intersects an adjacent line along which an adjacent group of spots is positioned at a point outside the midpoint of the adjacent line, and wherein the ratio of the distance separating the spots within each group of spots to the distance from an end-spot in each group to the next adjacent line along which an adjacent group of spots is positioned, is about 0.5 to about 3.0.

2. The fabric according to claim 1 wherein said ratio is about 0.8 to about 1.6.

3. The fabric according to claim 1 wherein the length of the line along which said groups of spots are positioned is about 1.5 to about 5 times the shortest distance separating said lines from each other.

4. The fabric according to claim 1 wherein the groups of spots are positioned along curved lines.

5. The fabric according to claim 1 wherein said steadily extended line and said adjacent line intersect at an angle of about 25° to about 90°.

6. The fabric according to claim 2 wherein said steadily extended line and said adjacent line intersect at an angle of about 45° to about 60°.

7. A fabric comprising a non-woven fabric wherein the fibers of said fabric are bonded to each other and/or to another fabric by a bonding agent and/or autogenously in a plurality of equally spaced-apart spots, wherein the spots are the same size and are combined in a plurality of identical groups of not less than three nor more than five spots, each of said groups of spots being spaced apart from each other, and each of said spots within each group being positioned along a curved or straight line, wherein the steady extension of said line beyond the end-spots of said group positioned along said line intersects an adjacent line along which an adjacent group of spots is positioned at a point outside the midpoint of the adjacent line, and wherein the ratio of the distance separating the spots within each group of spots to the distance from an end-spot in each group to the next adjacent line along which an adjacent group of spots is positioned is about 0.5 to about 3.0.

8. The fabric according to claim 7 wherein said ratio is about 0.8 to about 1.6.

9. The fabric according to claim 7 wherein said lines are curved.

10. The fabric according to claim 1 wherein said steadily extended line and said adjacent line intersect at an angle of about 25° to about 90°.

11. The fabric according to claim 8 wherein said steadily extended line and said adjacent line intersect at an angle of about 45° to about 60°.

12. The fabric according to claim 1 wherein said steadily extended line and said adjacent line intersect at an angle of about 25° to about 60°.

13. The fabric according to claim 7 wherein said steadily extended line and said adjacent line intersect at an angle of about 25° to about 60°.

* * * * *